US008926374B2

(12) United States Patent
Mu

(10) Patent No.: US 8,926,374 B2
(45) Date of Patent: Jan. 6, 2015

(54) ELECTRONIC CONNECTION UNIT AND SOCKET THEREOF

(75) Inventor: Yulong Mu, New Taipei (TW)

(73) Assignee: Wistron Corp., New Taipei (TW)

( * ) Notice: Subject to any disclaimer, the term of this patent is extended or adjusted under 35 U.S.C. 154(b) by 221 days.

(21) Appl. No.: 13/559,497

(22) Filed: Jul. 26, 2012

(65) Prior Publication Data

US 2013/0161162 A1 Jun. 27, 2013

(30) Foreign Application Priority Data

Dec. 21, 2011 (CN) ..... 2011 1 0432229

(51) Int. Cl.
*H01R 24/00* (2011.01)

(52) U.S. Cl.
USPC ..... 439/660

(58) Field of Classification Search
CPC ..... H01R 2105/00; H01R 24/005; H01R 23/7073; H01R 23/02; H01R 23/725; H01R 13/26; H01R 13/658
USPC ..... 439/660
See application file for complete search history.

(56) References Cited

U.S. PATENT DOCUMENTS

| | | | | |
|---|---|---|---|---|
| 2,726,372 | A * | 12/1955 | Appleton | 439/21 |
| 7,168,968 | B1 * | 1/2007 | Li | 439/172 |
| 7,168,969 | B1 * | 1/2007 | Wang | 439/173 |
| 8,197,260 | B2 * | 6/2012 | Wadsworth | 439/27 |

FOREIGN PATENT DOCUMENTS

| | | |
|---|---|---|
| TW | 438126 | 5/2001 |
| TW | 579097 | 3/2004 |

OTHER PUBLICATIONS

Taiwan Patent Office, Office Action, Patent Application Serial No. 100148547, Nov. 21, 2013, Taiwan.
China Patent Office, Office Action, Patent Application Serial No. 201110432229.9, Sep. 29, 2014, China.

* cited by examiner

*Primary Examiner* — Edwin A. Leon

(57) ABSTRACT

An electric connection unit is provided. The electric connection unit includes a plug and a socket. The plug includes a plurality of plug contacts. The socket includes a plurality of socket contacts, wherein an opening is formed on a socket surface of the socket, and a sliding space is formed in the socket. The opening is communicated to the sliding space, and the socket contacts are disposed in the sliding space. The plug contacts are inserted into the sliding space of the socket through the opening, and the plug contacts are rotated between a first orientation and a second orientation. When the plug contacts are in the first orientation, the plug contacts are separated from the socket contacts, and when the plug contacts are in the second orientation, the plug contacts are electrically connected to the socket contacts.

15 Claims, 8 Drawing Sheets

ELECTRONIC CONNECTION UNIT AND SOCKET THEREOF

CROSS REFERENCE TO RELATED APPLICATIONS

This Application claims priority of China Patent Application No. 201110432229.9, filed on Dec. 21, 2011, the entirety of which is incorporated by reference herein.

BACKGROUND OF THE INVENTION

1. Field of the Invention

The present invention relates to an electric connection unit, and in particular relates to an electric connection unit with a socket.

2. Description of the Related Art

Conventional sockets have various disadvantages. For example, when a child inserts a metal element into the conventional socket, he/she may be electrocuted. Additionally, for conventional sockets, the plug is fixed to the socket loosely, and the connection reliability therebetween is poor. For example, when a user trips over a wire of the plug, the plug is easily separated from the socket, and the power supplied from the socket is therefore terminated.

BRIEF SUMMARY OF THE INVENTION

An electric connection unit is provided. The electric connection unit includes a plug and a socket. The plug includes a plurality of plug contacts. The socket includes a plurality of socket contacts, wherein an opening is formed on a socket surface of the socket. A sliding space is formed in the socket, and the opening is communicated to the sliding space. The socket contacts are disposed in the sliding space, and the plug contacts are inserted into the sliding space of the socket through the opening. The plug contacts are rotated between a first orientation and a second orientation. When the plug contacts are in the first orientation, the plug contacts are separated from the socket contacts, and when the plug contacts are in the second orientation, the plug contacts are electrically connected to the socket contacts.

In the embodiment of the invention, after the plug is inserted into the socket, the specially designed plug contacts are rotated to contact the socket contacts. Therefore, when a child inserts a metal element into the socket of the embodiment of the invention, he/she will not be electrocuted. Additionally, the plug contacts abut a cover of the socket, and the plug will not be separated from the socket by gravity or an unplanned tug.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
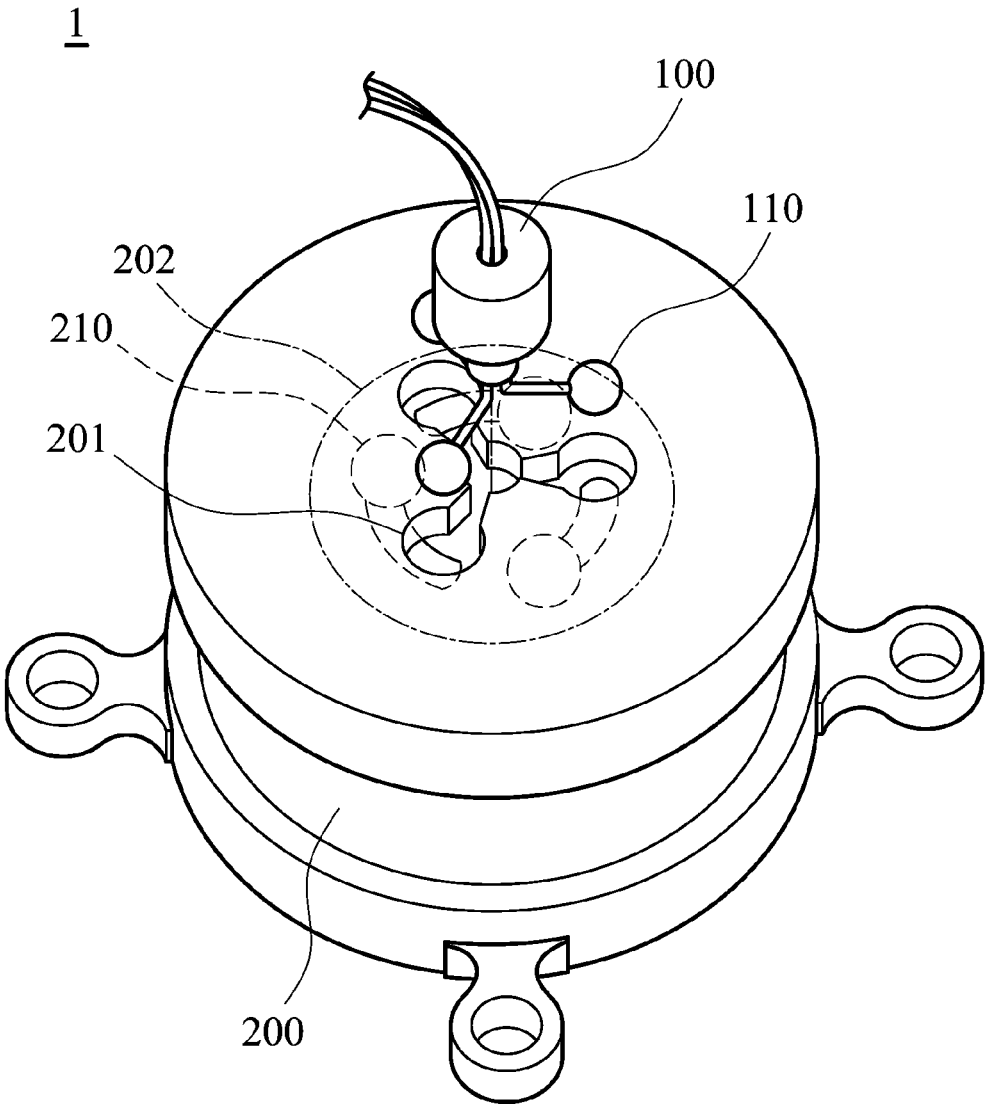
FIG. 1A shows the electric connection unit of an embodiment of the invention.
Figure 1B:
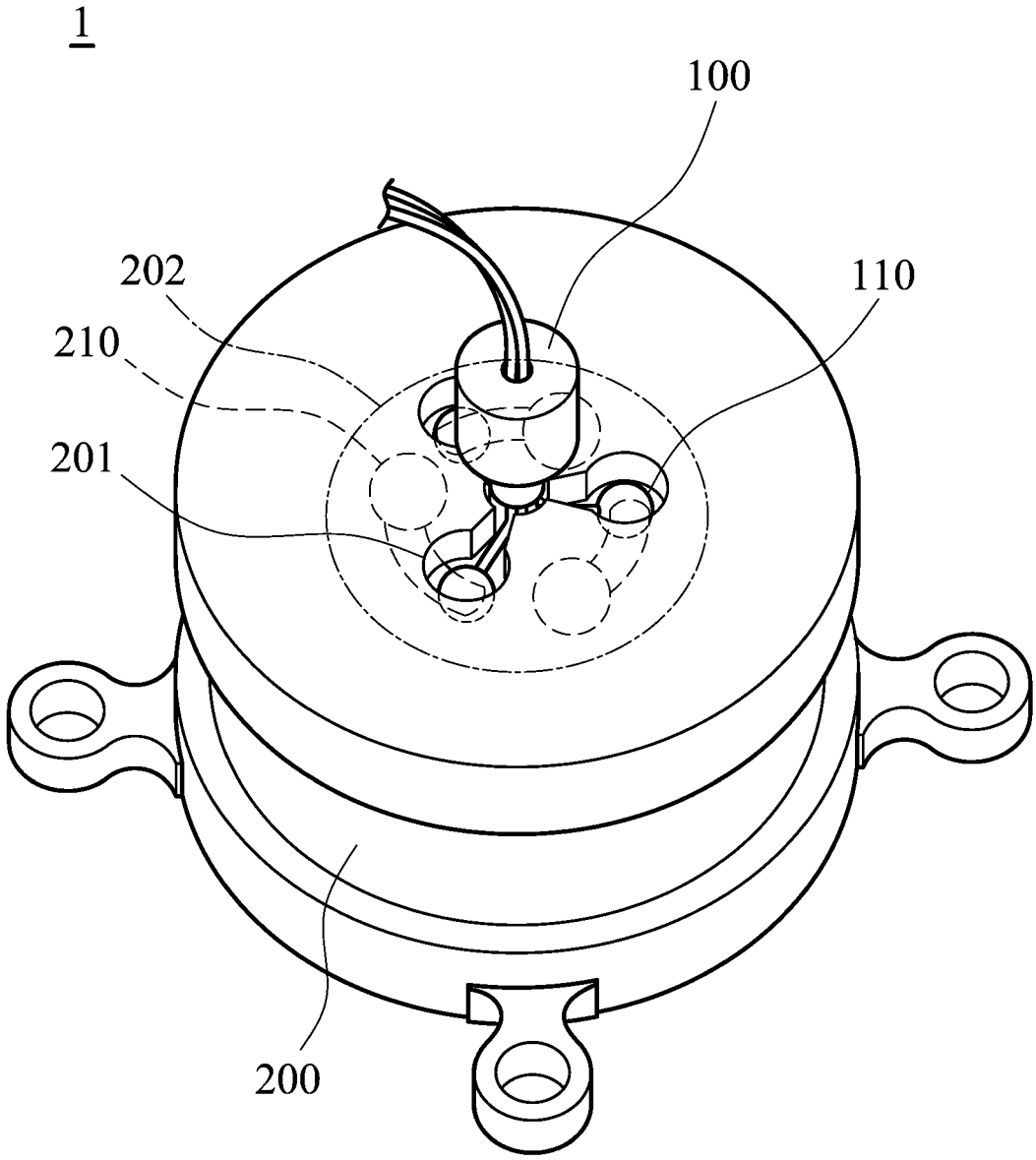
FIG. 1B shows the plug contacts of the embodiment of the invention in the first orientation.
Figure 1C:
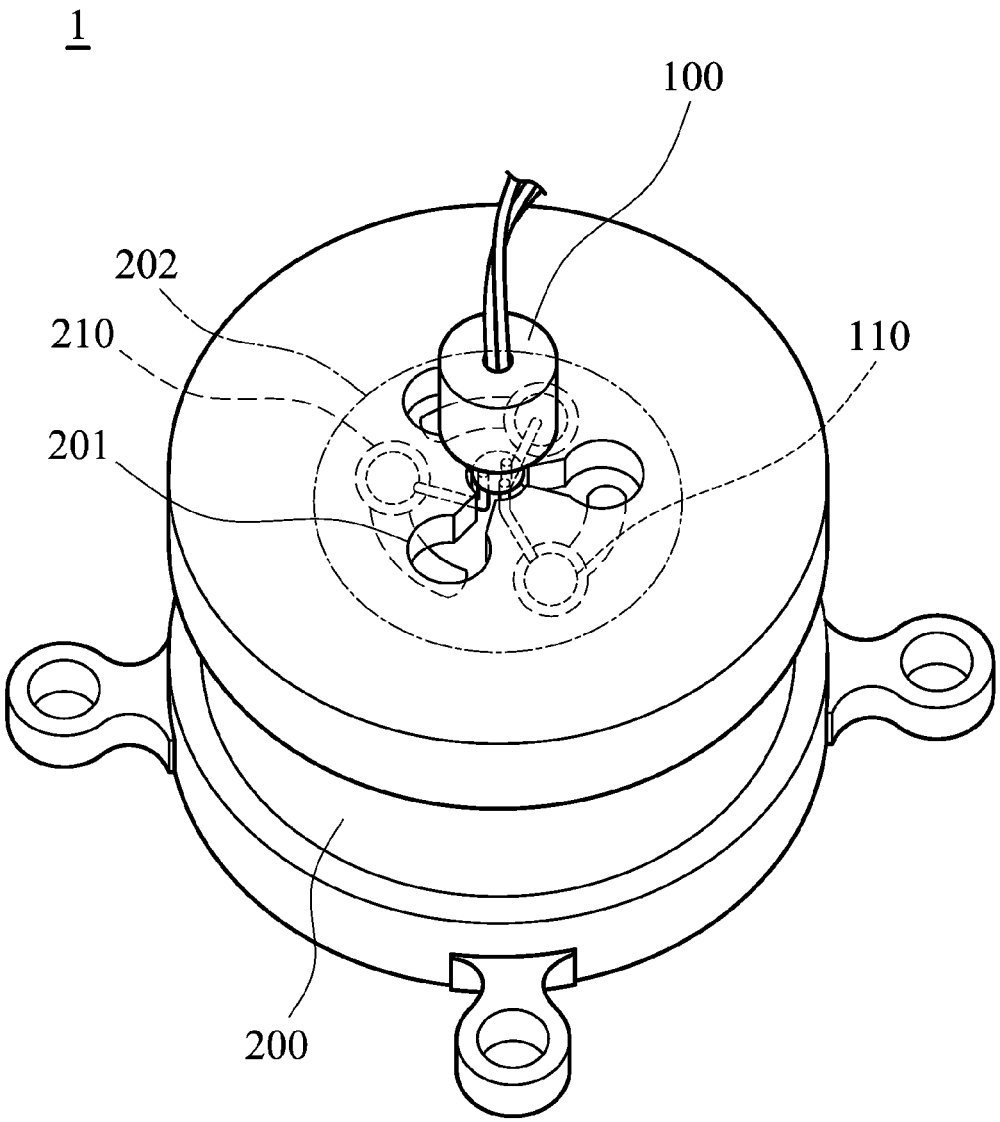
FIG. 1C shows the plug contacts of the embodiment of the invention in the second orientation.

FIG. 1A shows an electric connection unit 1 of an embodiment of the invention, including a plug 100 and a socket 200. The plug 100 comprises a plurality of plug contacts 110. The socket 200 comprises a plurality of socket contacts 210. An opening 201 is formed on a socket surface of the socket 200. A sliding space 202 is formed in the socket 200. The opening 201 is communicated to the sliding space 202. The socket contacts 210 are disposed in the sliding space 202. The plug contacts 110 are inserted into the sliding space 202 of the socket 200 through the opening 201, and the plug contacts 110 are rotated between a first orientation (FIG. 1B) and a second orientation (FIG. 1C). When the plug contacts 110 are in the first orientation, the plug contacts 110 are separated from the socket contacts 210. When the plug contacts 110 are in the second orientation, the plug contacts 110 are electrically connected to the socket contacts 210.

In the embodiment of the invention, after the plug 100 is inserted into the socket 200, the specially designed plug contacts 110 should be rotated to contact the socket contacts 210. Therefore, when a child inserts a metal element into the socket 200 of the embodiment of the invention, he/she will not be electrocuted. Additionally, the plug contacts 110 abut a cover of the socket 200, and the plug 100 will not be separated from the socket 200 by gravity or an unplanned tug.

Figure 2:
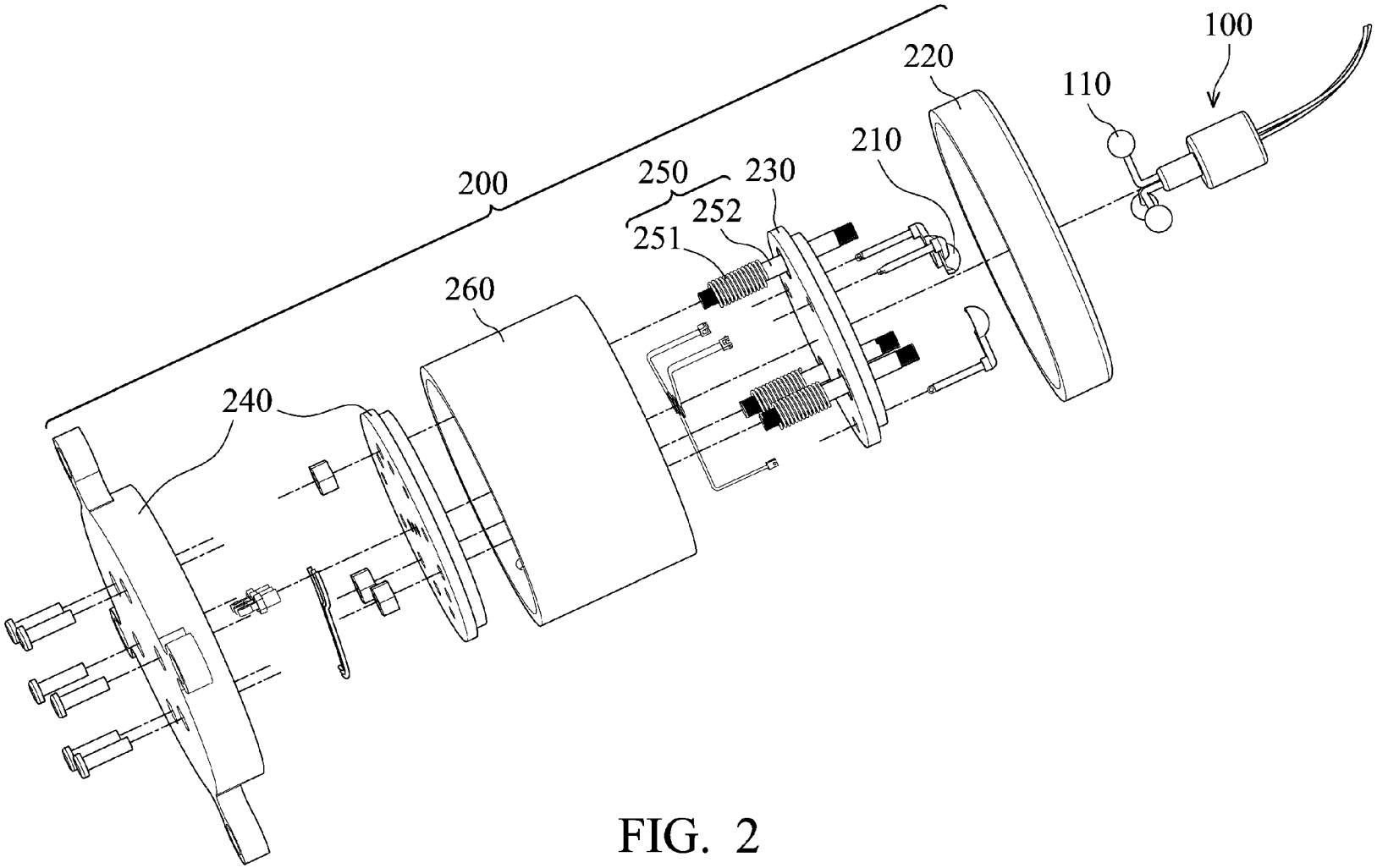
FIG. 2 is an exploded view of the socket of the embodiment of the invention.

FIG. 2 is an exploded view of the socket 200. The socket 200 comprises the cover 220, a stage 230, a base 240, an elastic unit 250 and a lateral wall 260. The sliding space 202 is formed between the cover 220 and the stage 230. When the plug 100 is inserted into the sliding space 202, the plug contacts 110 are rotated between the cover 220 and the stage 230. The elastic unit 250 connects the base 240 to the stage 230. The lateral wall 260 covers inner elements of the socket 200.

Figure 3A:
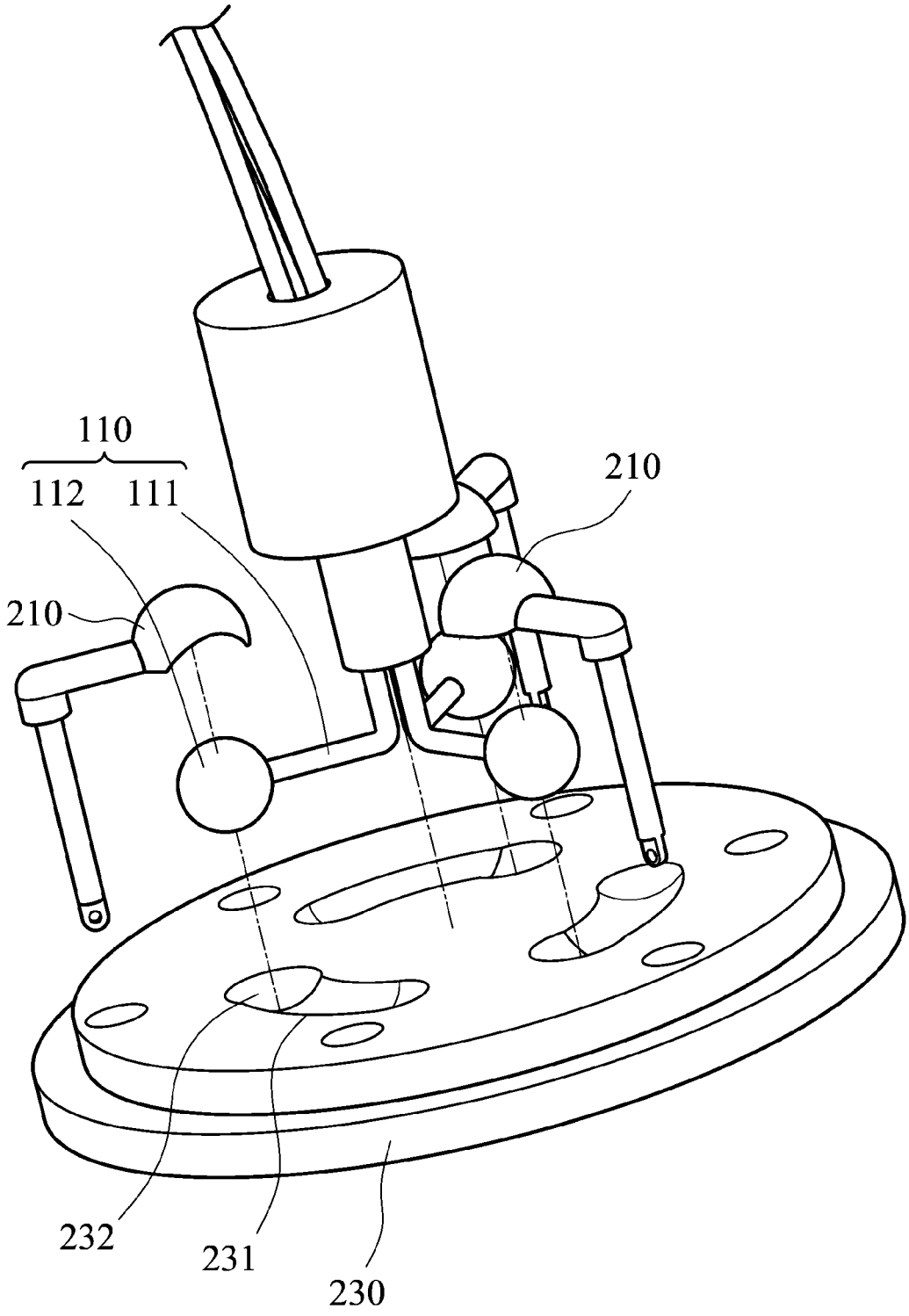
FIG. 3A shows the detailed structures of the plug and the stage of the embodiment of the invention.

With reference to FIG. 3A, each plug contact 110 comprises an extending portion 111 and a ball shaped contact portion 112, and the ball shaped contact portion 112 is formed on an end of the extending portion 111. A plurality of grooves 231 are formed on the stage 230, and each groove 231 has a recess 232, and the recesses 232 are corresponding to the socket contacts 210. When the plug contacts 110 are in the second orientation, the ball shaped contact portions 112 of the plug contacts 110 abut the recesses 232 and contact the socket contacts 210.

Figure 3B:
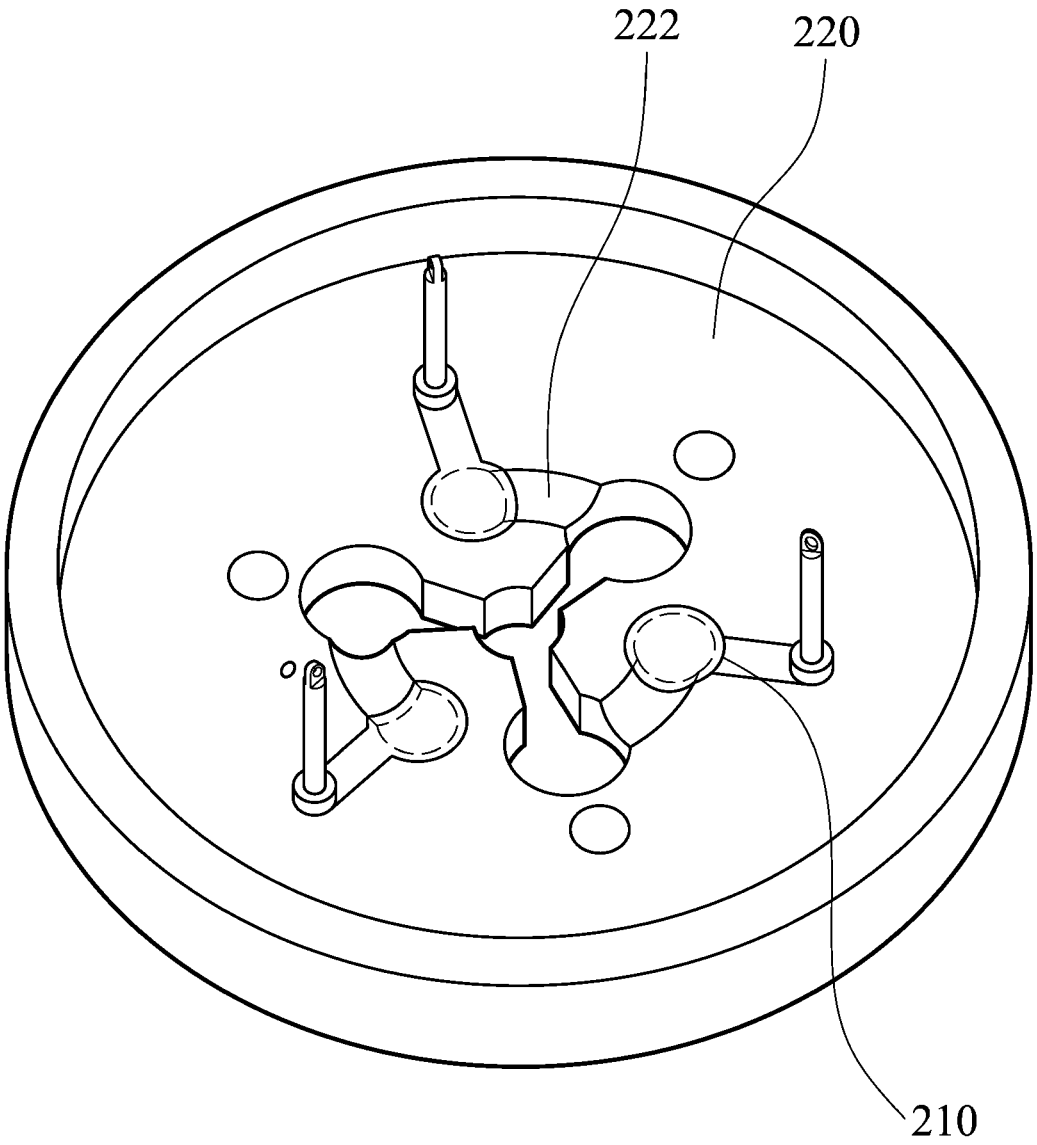
FIG. 3B shows the detailed structures of the cover of a modified example of the invention.

In this embodiment, the socket contacts 210 are bowl shaped and disposed on an inner surface of the cover. However, the invention is not limited thereby, and the socket contacts 210 can also be disposed in the recess 232 or other proper positions. Additionally, with reference to FIG. 3B, groves 222 can be formed on the inner surface of the cover 220 for guiding the ball shaped contact portion 112.

Figure 4A:
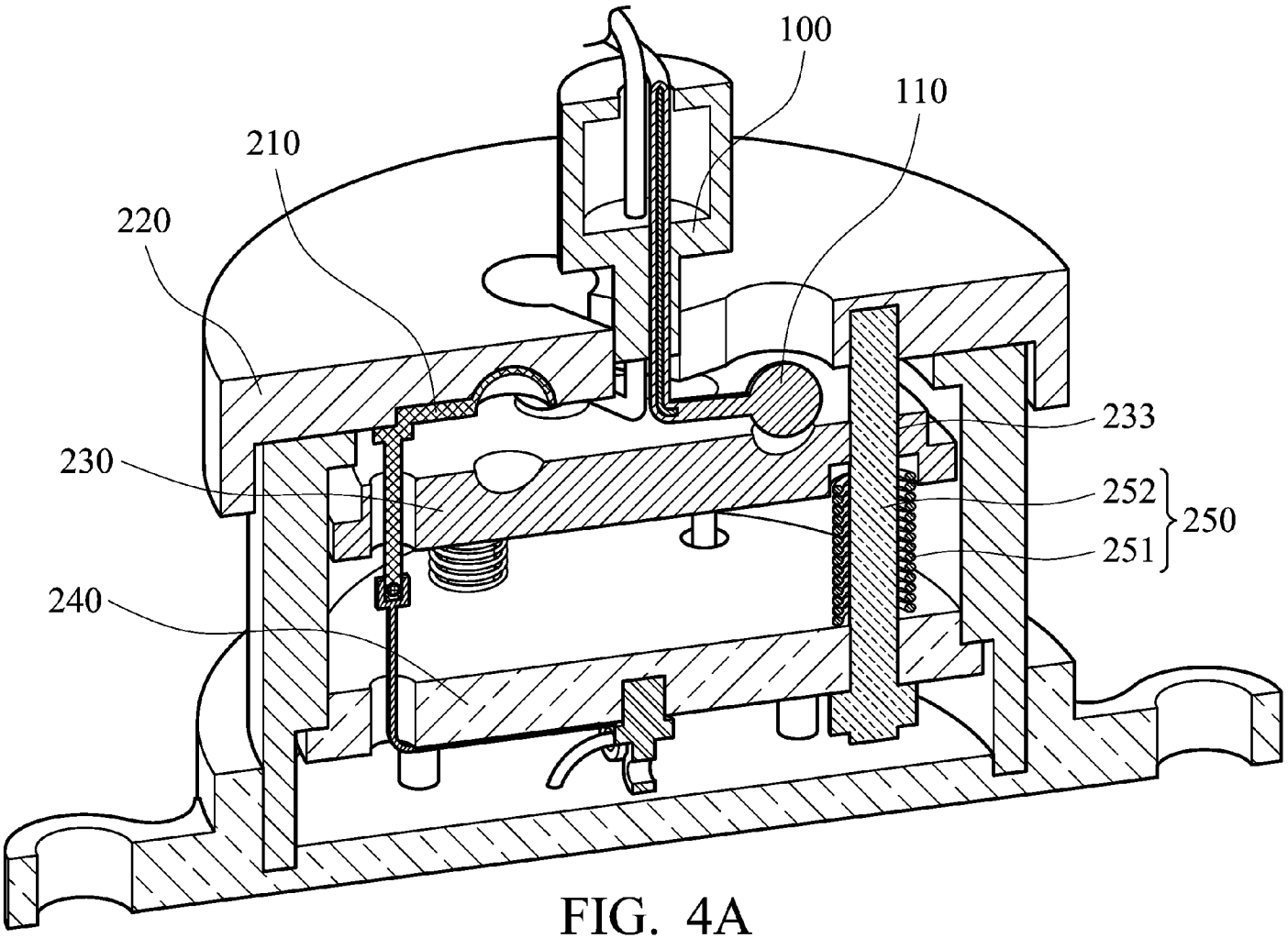
FIG. 4A shows the stage of the embodiment of the invention in the first position.
Figure 4B:
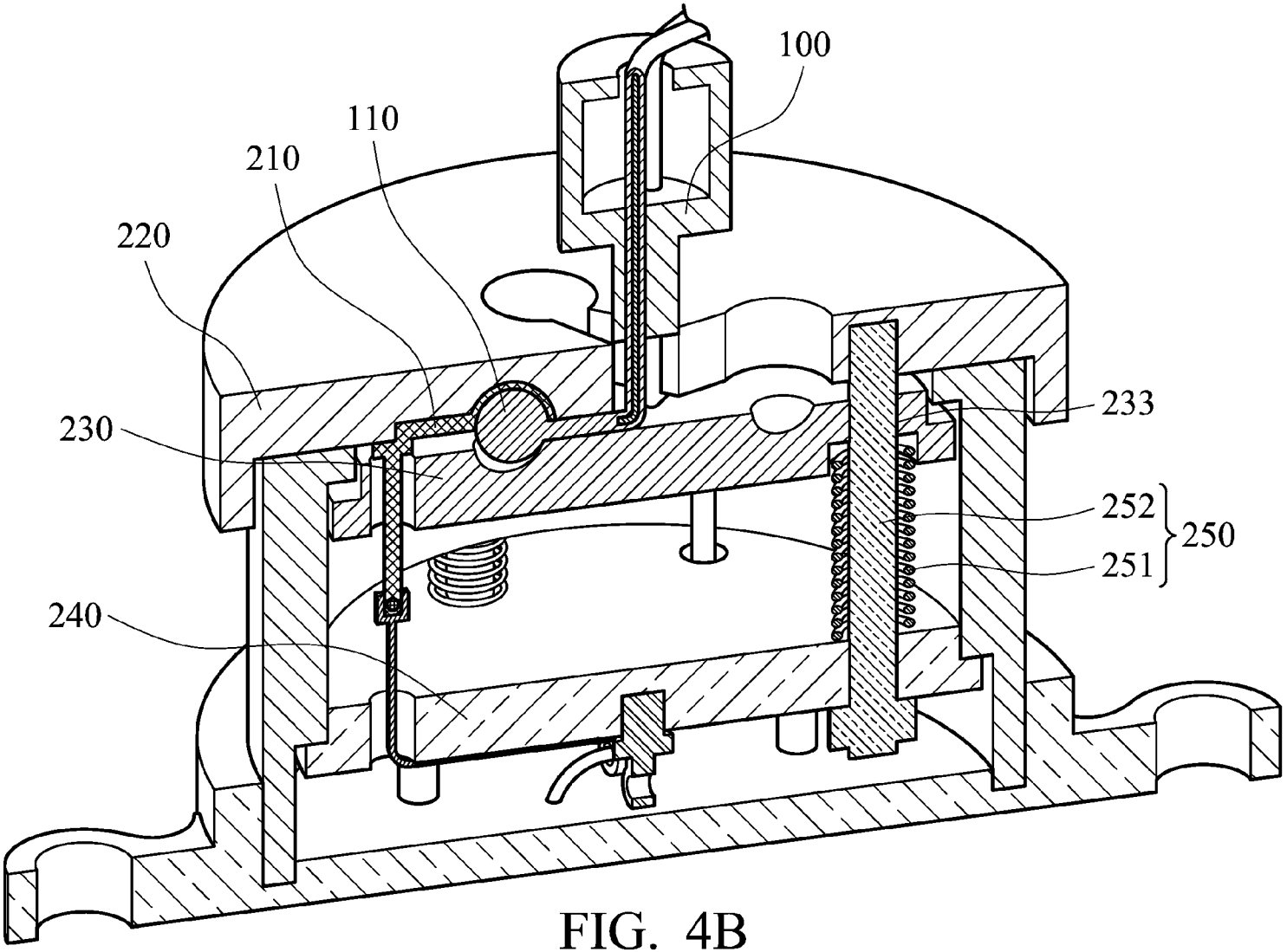
FIG. 4B shows the stage of the embodiment of the invention in the second position.

With reference to FIGS. 4A and 4B, the stage 230 is moved between a first position (FIG. 4A) and a second position (FIG. 4B) relative to the base 240. With reference to FIG. 4A, when the plug 100 is inserted into the socket 200, the plug 100 pushes the stage 230 to the first position. With reference to FIG. 4B, when the plug contacts 110 are rotated to the second orientation, the elastic unit 250 pushes the stage 230 to the second position to electrically connect the ball shaped contact portions 112 of the plug contacts 110 to the socket contacts 210. The elastic unit 250 comprises at least one elastic element 251 and a post 252. The elastic element 251 is disposed between the base 240 and the stage 230. At least one through hole 233 is formed on the stage 230, and the post 252 passes through the through hole 233 to guide the movement of the stage 230. The elastic element 251 is telescoped on the post 252, which can be an extension spring.

In the embodiment of the invention, the stage 230 is moved via elastic force between the first position (FIG. 4A) and the second position (FIG. 4B) relative to the base 240. The plug contacts 110 can be rotated between the first orientation and the second orientation in the sliding space, and the electric connection between the ball shaped contact portions 112 of the plug contacts 110 and the socket contacts 210 is ensured. However, the invention is not limited thereby. In a modified embodiment, the stage can be made of elastic material, and the position of the stage relative to the base can be fixed.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electric connection unit, comprising:

a plug, comprising a plurality of plug contacts; and a socket, comprising a plurality of socket contacts, wherein an opening is formed on a socket surface of the socket, a sliding space is formed in the socket, the opening is communicated to the sliding space, and the socket contacts are disposed in the sliding space, arranged such that when the plug contacts are inserted into the sliding space of the socket through the opening, the plug contacts are rotatable between a first orientation and a second orientation, and when the plug contacts are in the first orientation, the plug contacts are separated from the socket contacts, and when the plug contacts are in the second orientation, the plug contacts are electrically connected to the socket contacts, wherein the socket further comprises a cover and a stage, and the sliding space is formed between the cover and the stage, arranged such that when the plug is inserted into the sliding space, the plug contacts are rotatable between the cover and the stage, wherein a plurality of grooves are formed on the stage, and each groove has a recess, the recesses are corresponding to the socket contacts, and when the plug contacts are in the second orientation, the plug contacts abut the recesses.

2. The electric connection unit as claimed in claim 1, wherein each plug contact comprises an extending portion and a ball shaped contact portion, and the ball shaped contact portion is formed on an end of the extending portion, and when the plug contacts are in the second orientation, the ball shaped contact portions abut the recesses.

3. The electric connection unit as claimed in claim 2, wherein the socket contacts are bowl shaped, and when the plug contacts are in the second orientation, the ball shaped contact portions respectively contact the socket contacts.

4. An electric connection unit, comprising:

a plug, comprising a plurality of plug contacts; and a socket, comprising a plurality of socket contacts, wherein an opening is formed on a socket surface of the socket, a sliding space is formed in the socket, the opening is communicated to the sliding space, and the socket contacts are disposed in the sliding space, arranged such that when the plug contacts are inserted into the sliding space of the socket through the opening, the plug contacts are rotatable between a first orientation and a second orientation, and when the plug contacts are in the first orientation, the plug contacts are separated from the socket contacts, and when the plug contacts are in the second orientation, the plug contacts are electrically connected to the socket contacts, wherein the socket further comprises a cover and a stage, and the sliding space is formed between the cover and the stage, arranged such that when the plug is inserted into the sliding space, the plug contacts are rotatable between the cover and the stage, wherein the socket contacts are disposed on an inner surface of the cover.

5. An electric connection unit, comprising:

a plug, comprising a plurality of plug contacts; and a socket, comprising a plurality of socket contacts, wherein an opening is formed on a socket surface of the socket, a sliding space is formed in the socket, the opening is communicated to the sliding space, and the socket contacts are disposed in the sliding space, arranged such that when the plug contacts are inserted into the sliding space of the socket through the opening, the plug contacts are rotatable between a first orientation and a second orientation, and when the plug contacts are in the first orientation, the plug contacts are separated from the socket contacts, and when the plug contacts are in the second orientation, the plug contacts are electrically connected to the socket contacts, wherein the socket further comprises a cover and a stage, and the sliding space is formed between the cover and the stage, arranged such that when the plug is inserted into the sliding space, the plug contacts are rotatable between the cover and the stage, wherein the socket further comprises a base and an elastic unit, and the elastic unit connects the base to the stage, and the stage is movable between a first position and a second position relative to the base, arranged such that when the plug is inserted into the socket, the plug pushes the stage to the first position, and when the plug contacts are rotated to the second orientation, the elastic unit pushes the stage to the second position to electrically connect the plug contacts to the socket contacts.

6. The electric connection unit as claimed in claim 5, wherein the elastic unit comprises at least one elastic element, and the elastic element is disposed between the base and the stage.

7. The electric connection unit as claimed in claim 6, wherein the elastic unit further comprises at least one post, and at least one through hole is formed on the stage, and the post passes through the through hole to guide the movement of the stage.

8. The electric connection unit as claimed in claim 7, wherein the elastic element is telescoped on the post.

9. A socket, comprising:

a cover, wherein an opening is formed on the cover;

a stage, wherein a sliding space is formed between the cover and the stage, and the opening is communicated to the sliding space; and a plurality of socket contacts, disposed in the sliding space, wherein the socket further comprises a base and an elastic unit, and the elastic unit connects the base to the stage, and the stage is movable between a first position and a second position relative to the base.

10. The socket as claimed in claim 9, wherein a plurality of grooves are formed on the stage, and each groove has a recess, and the recesses are corresponding to the socket contacts.

11. The socket as claimed in claim 10, wherein the socket contacts are bowl shaped.

12. The electric connection unit as claimed in claim 9, wherein the socket contacts are disposed on an inner surface of the cover.

13. The socket as claimed in claim 9, wherein the elastic unit comprises at least one elastic element, and the elastic element is disposed between the base and the stage.

14. The socket as claimed in claim 13, wherein the elastic unit further comprises at least one post, and at least one through hole is formed on the stage, and the post passes through the through hole to guide the movement of the stage.

15. The socket as claimed in claim 14, wherein the elastic element is telescoped on the post.

* * * * *